United States Patent [19]

Combs et al.

[11] Patent Number: 4,699,696

[45] Date of Patent: Oct. 13, 1987

[54] ZINC-NICKEL ALLOY ELECTROLYTE AND PROCESS

[75] Inventors: Daniel J. Combs, Sterling Heights; Sylvia Martin, Utica; Robert A. Tremmel, Woodhaven; Kenneth D. Snell, Rochester, all of Mich.; Masaaki Kamitani, Tokyo, Japan; Ryoichi Kimizuka, Kanagawa, Japan; Takaaki Koga, Kanagawa, Japan

[73] Assignees: OMI International Corporation, Warren, Mich.; Ebara-Udylite Co., Ltd., Tokyo, Japan

[21] Appl. No.: 850,465

[22] Filed: Apr. 15, 1986

[51] Int. Cl.[4] ..... C25D 3/22; C25D 3/56

[52] U.S. Cl. ..... 204/44.2; 204/44.5; 204/123

[58] Field of Search ..... 204/44.2, 44.5, 123

[56] References Cited

U.S. PATENT DOCUMENTS

| | | | |
|---|---|---|---|
| 2,840,517 | 6/1958 | Faust et al. | 204/44.5 |
| 4,514,267 | 4/1985 | Lash | 204/44.2 |
| 4,543,166 | 9/1985 | Lash | 204/44.2 |
| 4,592,809 | 6/1986 | Fong et al. | 204/44.2 |

FOREIGN PATENT DOCUMENTS

| | | | |
|---|---|---|---|
| 718502 | 2/1980 | U.S.S.R. | 204/44.2 |

OTHER PUBLICATIONS

IPN WO83/02290, Jul. 7, 1983.

*Primary Examiner*—Arthur P. Demers
*Attorney, Agent, or Firm*—Richard P. Mueller

[57] ABSTRACT

An aqueous acidic electrolyte of the chloride, sulfate and mixed chloride-sulfate types suitable for electrodepositing a zinc-nickel alloy on a conductive substrate comprising an aqueous solution containing zinc ions and nickel ions, and an additive agent of a class selected from the group consisting of (a) aromatic sulfonic acids, (b) aromatic sulfonamides, sulfonimides and mixed carboxamides/sulfonamides, (c) acetylene alcohols as well as the bath soluble and compatible salts and mixtures thereof. The invention further encompasses the process for electrodepositing a zinc-nickel alloy employing the aforementioned electrolyte.

33 Claims, No Drawings

ZINC-NICKEL ALLOY ELECTROLYTE AND PROCESS

BACKGROUND OF THE INVENTION

The present invention broadly relates to an improved electrolyte and process for electrodepositing zinc-nickel alloys, and more particularly, to an improved aqueous acidic zinc-nickel alloy electrolyte of the chloride, sulfate, and mixed chloride-sulfate type containing novel additive agents for providing improved ductility to the electrodeposit and/or improving the uniformity in the composition of the alloy electrodeposit over a broad range of current densities.

Electrolytes incorporating controlled amounts of zinc ions and nickel ions have heretofore been used or proposed for use for depositing a zinc-nickel alloy plate of a decorative or functional type on a variety of substrates such as iron and steel, for example, to provide for improved corrosion resistance, enhanced appearance and/or to build up the surface of a worn part enabling refinishing thereof to restore its original operating dimensions. Such zinc-nickel alloy electrolytes and processes are in widespread commercial use for industrial or functional plating including strip plating, conduit plating, wire plating, rod plating, tube plating, coupling plating and the like.

While substantial improvements have been made to achieve a desired grain-refinement of the alloy electrodeposit to achieve the requisite semi-bright appearance including improved adhesion, a continuing problem has been the lack of ductility of the zinc-nickel alloy deposit resulting in micro-cracking which significantly reduces the corrosion protection of the zinc-nickel alloy deposit on the substrate. A further problem associated with electrolytes heretofore known has been the tendency of the electrodeposit to vary significantly in the quantity of nickel in the zinc-nickel alloy as a result of variations in the current density at different areas of the article being plated. Such variations in the nickel content of the electrodeposit can adversely affect subsequent treatment of the electroplated article with conventional chromium containing rinse solutions for applying a chromium-containing protective coating on the electrodeposit further enhancing its corrosion resistance. It has generally been observed that when the zinc-nickel alloy contains above about 17% by weight nickel, the application of such subsequent chromium-rinse treatments in adversely affected. It has further been observed that when the nickel concentration in the electrodeposit exceeds about 25% by weight, the deposit becomes of a darkened color which detracts from the appearance of a plated article and the chromating of such dark deposits is substantially impaired resulting in reduced corrosion resistance.

The foregoing problems and disadvantages are overcome in accordance with the present invention whereby the improved electrolyte incorporating novel additive agents and the process of electrodepositing a zinc-nickel alloy employing such electrolyte produces electrodeposits which are of substantially improved ductility, provide for increases in the nickel content in the zinc-nickel alloy deposit thereby enabling the use of lower concentrations of nickel ions in the electrolyte to achieve the same nickel content thereby providing for substantial cost savings, and which provides for increased nickel deposition in the high current density areas and suppresses nickel codeposition in the low current density areas whereby an alloy deposit is obtained which is of more uniform composition over a broad range of current density areas. The process in accordance with the present invention is therefore more economical to operate, simpler to control and provides for increased uniformity in the composition of the deposit which is possessed of improved physical and chemical properties.

SUMMARY OF THE INVENTION

The benefits and advantages of the present invention in accordance with the composition aspects thereof are achieved by an aqueous acidic zinc-nickel alloy electrolyte of the chloride, sulfate and mixed chloride-sulfate type containing zinc ions and nickel ions in an amount sufficient to electrodeposit a zinc-nickel alloy of the desired alloy composition. The electrolyte, especially those which contain chlorides, further may contain a polyoxyalkylene compound as well as the bath soluble terminally substituted derivatives and mixtures thereof present in an amount effective to impart grain refinement to the electrodepoit. Additionally, the electrolyte contains an additive agent of a class selected from the group consisting of:

(a) aromatic sulfonic acids;

(b) aromatic sulfonamides, sulfonimides and mixed carboxamide/sulfonamides;

(c) acetylene alcohols;

as well as the bath soluble and compatible salts of (a) and (b) and mixtures thereof; the additive agents (b) and (c) being present in a chloride, sulfate and mixed chloride-sulfate electrolyte in an amount effective to impart ductility to the electrodeposit, while the additive agents (a), (b) and (c) being present in a chloride and mixed chloride-sulfate electrolyte in an amount effective to provide a substantially uniform alloy composition by suppression of nickel codeposition in the low current density areas.

Typically, an improvement in the ductility of the electrodeposit from chloride, sulfate and mixed chloride-sulfate electrolytes is achieved when additive agents (b) and (c) are present in an amount of at least about 0.0001 mole per liter. An improvement in the uniformity of the composition of the alloy deposit in chloride and mixed chloride-sulfate electrolytes employing additive agents (a), (b) and (c) has been observed with concentrations of at least about 0.001 mole per liter.

In addition to the foregoing constituents, the electrolyte can include secondary brightening agents as well as auxiliary brightening agents as may be desirable for electrodepositing zinc-nickel alloy deposits of a decorative bright appearance. Buffering agents of any of the types known in the art can also be included for stabilizing the pH of the electrolyte within a range of from about 0 up to about neutral with a pH of from about 2 to about 6 being preferred.

In accordance with the process aspects of the present invention, a zinc-nickel alloy electrodeposit is produced on a conductive substrate employing the aforementioned aqueous electrolyte which is controlled at a temperature typically ranging from about room temperature (60° F.) up to about 180° F. and is operated at an average cathode current density ranging from as low as about 1 up to about as high as about 2,000 amperes per square foot (ASF) or higher which will vary depending upon the specific type and composition of the electrolyte as well as the geometry and processing parameters employed in the plating operation.

Further benefits and advantages of the present invention will become apparent upon a reading of the description of the preferred embodiments taken in conjunction with the specific examples provided.

DESCRIPTION OF THE PREFERRED EMBODIMENTS

The aqueous acidic zinc-nickel alloy electrolyte in accordance with the composition aspects of the present invention comprises an aqueous solution containing zinc ions present in an amount effective to electrodeposit zinc from the electrolyte and generally can range from as low as about 10 g/l up to saturation, with concentrations of from about 15 to about 225 g/l being more usual. Preferably, for most applications, the zinc ion concentration is controlled within a range of about 20 to about 200 g/l. The maximum concentration of zinc ions will vary depending upon the temperature of the electrolyte with higher temperatures enabling the use of higher concentrations. The zinc ion concentration will also vary depending upon the type of electrolyte employed which may be of the chloride, sulfate and mixed chloride-sulfate type. In acid chloride-type electrolytes, the zinc ion concentration is generally controlled at a level within the lower end of the permissible concentration range as hereinbefore described whereas in acid sulfate-type electroltyes, the zinc ion concentration is generally controlled at a level within the upper range of the permissible concentrations.

The zinc ions are introduced into the electrolyte in the form of soluble zinc salts such as a chloride or sulfate salt in combination with an acid such as hydrochloric acid or sulfuric acid corresponding to the type of zinc salt employed. Generally, the pH of the zinc-nickel alloy electrolyte is controlled within a range of about 0 up to about 7 with a pH of from abut 2 to about 6 being preferred.

In addition to the zinc ions, the electrolyte further contains a controlled amount of nickel ions which similarly are introduced in the form of bath soluble salts such as the chloride and sulfate salts depending upon whether the electrolyte is of the chloride, sulfate or mixed chloride-sulfate type. The concentration of nickel ions can generally range from about 0.5 g/l up to about 120 g/l to provide a zinc-nickel alloy deposit generally containing from about 0.1 up to about 30% by weight nickel. Preferably, the zinc-nickel alloy deposit contains from at least about 3 up to about 15% by weight nickel. For decorative zinc-nickel alloy deposits, it is preferred to maintain the weight ratio of zinc ions to nickel ions in the electrolyte below about 2.5. A replenishment of the zinc and nickel ions during use of the electrolyte for electrodepositing the zinc-nickel alloy, can satisfactorily be achieved by using zinc and nickel metal anodes or a zinc-nickel alloy anode which progressively dissolve in the electrolyte during the electrolysis. Adjustments in the concentration during operation can also be made by the addition of supplemental zinc and nickel salts of the type previously mentioned for electrolyte make-up.

In addition to the zinc and nickel ions, the zinc-nickel alloy electrolyte further contains an additive agent of a class selected from the group consisting of:

(a) aromatic sulfonic acids in accordance with General Formula I;

GENERAL FORMULA I

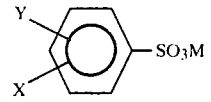

Wherein:

M is H, $NH_4$, or Group IA and IIA metals, zinc or nickel;

X is H, $C_1$–$C_6$ alkyl, $C_1$–$C_6$ hydroxyalkyl, $C_6$–$C_{10}$ aryl, $C_7$–$C_{22}$ aryl alkyl, or halogen, bath soluble polyalkylaryl; $SO_3M$, or CHO; in which the aryl substituent can be an adjacent ring compound;

Y is H, $C_1$–$C_6$ alkyl, $SO_3M$ or halogen;

R is H or $C_1$–$C_3$ alkyl; as well as mixtures thereof.

(b) aromatic sulfonamides, sulfonimides and mixed carboxamides/sulfonamides in accordance with General Formula II;

GENERAL FORMULA II

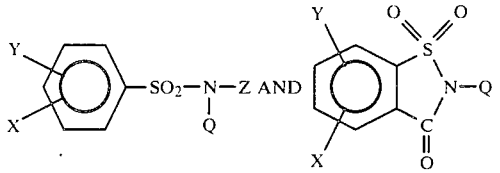

Wherein:

X is H, $C_1$–$C_6$ alkyl, $C_6$–$C_{10}$ aryl which can be adjacent to the phenyl ring, $C_7$–$C_{22}$ alkyl aryl, OH, halogen, CHO, $C_1$–$C_4$ alkoxy, $C_1$–$C_6$ carboxy, $C_1$–$C_6$ hydroxyl alkyl, or $C_1$–$C_6$ sulfoalkyl;

Y is H, $C_1$–$C_6$ alkyl, OH, $SO_3M$, or phenyl;

Q is H, M, $C_1$–$C_3$ alkyl, $C_1$–$C_6$ sulfo alkyl, $C_1$–$C_6$ hydroxy alkyl, $C_1$–$C_4$ alkoxy sulfo;

M is H, $NH_4$, Zinc, Nickel or Group IA and IIA metals;

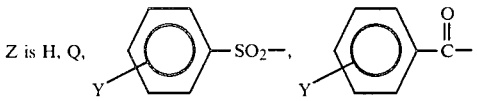

as well as mixtures thereof.

(c) acetylene alcohols in accordance with General Formula III;

GENERAL FORMULA III

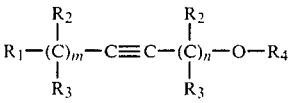

wherein:

m is an integer from 0 to 4;

n is an integer from 1 to 4

$R_1$ is H, a $C_1$–$C_6$ alkyl when m is O;

$R_1$ is —O—$R_4$ when m is greater than O;

$R_2$ & $R_3$ is H, $C_1$–$C_4$ alkyl or sulfo alkyl;

$R_4$ is H or

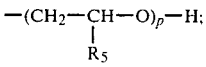

p is an integer from 1 to 4;

$R_5$ is H or a $C_1$–$C_2$ alkyl;

as well as the bath soluble and compatible salts of (a), (b) and mixtures thereof; the additive agents (b) and (c) being present in a chloride, sulfate and mixed chloride-sulfate electrolyte in an amount effective to impart ductility to the electrodeposit, while the additive agents (a), (b) and (c) being present in a chloride and mixed chloride-sulfate electrolyte in an amount effective to provide a substantially uniform alloy composition by suppression of nickel codeposition in the low current density areas.

Typical of the additive agents which can be satisfactorily employed are those as setforth in the following table:

TABLE 1

| ADDITIVE AGENTS |
|---|
| (a) Aromatic sulfonic acids: |
| (1) Sodium benzene sulfonic acid |
| (2) Sodium 1-naphthalene sulfonic acid |
| (b) Aromatic sulfonamide, sulfonimides and mixed carboxamides/sulfonamides: |
| (3) Benzene sulfonamide |
| (4) Sodium saccharin |
| (c) Acetylene alcohols: |
| (5) 3-methyl-1-butyne-3-ol; |
| (6) $HC{\equiv}CC(CH_3)_2O(CH_2CH_2O)_2H$ comprising the ethylene oxide adduct of 3-methyl-1-butyne-3-ol; |
| (7) Butynediol; |
| (8) $HOCH_2CH_2OCH_2{\equiv}CCH_2OCH_2CH_2OH$ comprising the ethylene oxide adduct of butynediol; |
| (9) $HOCH_2C{\equiv}CCH_2OCH_2CH_2OH$; |
| (10) Propargyl alcohol; |
| (11) $HC{\equiv}CCH_2OCH_2CH_2OH$ comprising the ethylene oxide adduct of propargyl alcohol; |
| (12) $HC{=}CCH_2OCH_2CH(CH_3)OH$ comprising the propylene oxide adduct of propargyl alcohol and; |
| (13) Hexynediol |

The specific compounds as listed in the foregoing Table 1 have been designated by a number for identification of the additive agents performance in comparative tests as set forth in subsequent Examples 9–21. In addition to Class (a) additive agents (1) and (2), Class (a) can also typically include C1–C4 alkyl substituted benzene and naphthalene acids and salts thereof such as benzene sulfonic acids (mono-, di-, and tri-), p-bromo benzene sulfonic acid, benzaldehyde sulfonic acids (o, m, p), diphenyl sulfone sulfonic acid, napthalene sulfonic acids (mono-, di-, and tri-), benzene sulfohydroxamic acid, p-Chlorobenzene sulfonic acid, diphenyl sulfonic acid, dichlorobenzene sulfonic acids, 3-phenyl-2-propyne-1-sulfonic acid, and the like.

In addition to Class (b) additive agents (3) and (4) of Table 1, Class (b) can also typically include: m-benzene sulfonamide, N-sulfopropylsaccharin, o-benzoic sulfimide, benzene disulfonamide, toluene sulfonamide (o, p), naphthalene sulfonamide (alpha, beta), N(-2-hydroxypropyl 3-sulfonic acid) N-phenylsulfonyl benzamide, N-benzoyl benzene sulfonimide, p-toluene sulfonchloramide, p-bromobenzene sulfonamide, p-benzoic sulfonamide, benzoic sulfondichloramide (o, p), p-toluene sulfonchloramide, p, p'-diphenyl disulfonamide, benzene m-disulfonamide, 6-chlor-o-benzoyl sulfonimide, m-formylbenzene sulfonamide, sulfomethyl benzene sulfonamide, benzene sulfonamide m-carboxamide, 7-formyl-o-benzoyl sulfimide, N-acetyl benzene sulfonimide, methoxy benzene sulfonamide, hydroxymethyl benzene sulfonamide, p-carboxamide benzene sulfonamide, p-chloro benzene sulfonamide, N-sulfo ethylsaccharin.

It has been found that compounds of the Classes (b) and (c) are effective in chloride, sulfate and mixed chloride-sulfate electrolytes for substantially improving the ductility of the electrodeposit thereby substantially eliminating microcracking and substantially improving the corrosion resistance of the electrodeposit on a substrate such as steel. For this purpose, it has been observed that concentrations of compounds in Classes (b) and (c) as well as mixtures thereof as low as about 0.0001 mole per liter are effective. While concentrations as high as 0.1 mole per liter can be employed, satisfactory improvements in ductility can be obtained at lower concentrations and for economic considerations, it is generally preferred to employ concentrations ranging from about 0.001 up to about 0.01 mole per liter.

It has also been discovered that additives of the Classes (a), (b) and (c) as well as mixtures thereof are effective in chloride and mixed chloride-sulfate type electrolytes to produce more uniform alloy electrodeposits over a broad range of cathode current densities when employed at concentrations generally greater than about 0.001 up to about 0.1 mole per liter and preferably at concentrations of at least about 0.01 mole per liter. In zinc-nickel alloy electrolytes of the types heretofore known, it has been observed during the electroplating of intricate parts, that the concentration of nickel increases in the low cathode current density areas of the part in comparison to the nickel content of the alloy deposit in the high current density areas. By the use of the additive agent in accordance with the present invention, the codeposition of nickel in the low current density areas is retarded such that the nickel content in the alloy deposit remains substantially uniform over the entire surface being plated. The additive agent also has been found to improve the cathode efficiency in the low current density areas whereby the throwing power of the bath is increased and the corrosion resistance of the plated part is improved. While this improvement can be achieved in chloride and mixed chloride-sulfate electrolytes, the use of such additives in sulfate type electrolytes provides only an improvement in ductility and does not significantly affect the suppression of nickel codeposition in the low current density areas.

In addition to the foregoing essential ingredients, the electrolyte may also contain, and preferably for a chloride containing electrolyte, a polyoxyalkylene compound as a carrier brightener present in an amount sufficient to provide grain refinement of the zinc-nickel alloy electrodeposit and to produce a deposit in the absence of supplemental and auxiliary brightening agents which is at least semi-bright in appearance. For this purpose, concentrations of the polyoxyalkylene compound can be employed as low as about 0.005 g/l up to saturation with concentrations of from about 0.1 up to 200 g/l being preferred. Typically the concentration of such polyoxyalkylene compounds will range from about 0.02 up to about 20 g/l with concentrations of about 0.02 to about 5 g/l being preferred for most uses.

The polyoxyalkylene compound may be of an ionic as well as nonionic type and may further comprise electrolyte soluble terminally substituted derivatives and mixtures thereof. Typical of the nonionic polyoxyalkylene compounds useful in the practice of the present invention are condensation copolymers of one or more alkylene oxides and another compound, in which the alkylene oxide contains from one to four carbon atoms and the resulting copolymer product contains from about 10 to about 70 moles of the alkylene oxide per mole of the other compound. Exemplary of such other compounds which may be alkoxylated are alcohols, including linear alcohols, aliphatic monohydric alcohols, aliphatic polyhydric alcohols, acetylenic mono or polyols, and phenol alcohols; fatty acids; fatty amides; alkyl phenols; alkyl naphthols; aliphatic amines, including both mono and poly amines; and the like.

Examples of typical suitable polyoxyalkylene compounds of this type are:

A. Nonionic copolymers of alkylene oxide and linear alcohols having the following structural formula:

$$\begin{array}{l} CH_3-(CH_2)_x-CH_3 \\ \quad\quad\quad\;\; | \\ \quad\quad\quad\;\; O-(CH_2-CH_2)_n-H \end{array}$$

wherein x is an integer from 9–15 and n is an integer from 10–50.

B. Nonionic copolymers of alkylene oxide and phenol alcohols having the following structural formula:

$H-(CH_2)_x-Ar-O-(CH_2CH_2O)_n\ CH_2\ CH_2\ OH$ wherein Ar is a benzene ring, x is an integer from 6–15 and n is an integer from 10–50.

C. Nonionic homopolymers of alkylene oxides selected from the group consisting of ethylene oxide, propylene oxide, glycidol, butylene oxide and mixtures thereof.

D. Other specific examples of nonionic polyoxyalkylene compounds useful in the present invention include, for example, alkoxylated: alkyl phenols, e.g., nonylphenol; alkyl naphthols; aliphatic monohydric alcohols; hexyne and decyne diols; ethylene diamine; tetraethanol; fatty acids, fatty alkanol amides, e.g., amide of coconut fatty acid; or esters, e.g., sorbitan monopalmitate.

Instead of the foregoing nonionic polyoxyalkylene compounds, bath soluble terminally substituted polyoxyalkylene compounds can also be employed which are derived from the sulfation, amination, phosphating, chlorination, bromination, phosphonation, sulfonation, carboxylation as well as combinations thereof of:

(1) the polymerization of alkylene oxides selected from the group consisting of ethylene oxide, propylene oxide, glycidol, butylene oxide and mixtures thereof; and (2) the alkoxylation of mono and polyhydroxy compounds selected from the group consisting of hydroxyl containing alkyl, alkenyl, alkynyl, aryl, as well as mixtures thereof.

The molecular weight of the polyoxyalkylne compound or mixtures thereof is controlled to render the additive agent soluble in the electrolyte at the concentration desired. It will also be appreciated that the terminally substituted compounds may contain one terminal substitute group on the molecule or may contain more than one terminal substitute group depending upon the degree of substitution and the number of reactive hydroxyl groups on the molecule.

In addition or in place of the foregoing polyoxyalkylene carrier brighteners, other polymeric carrier brighteners may be included in the zinc-nickel alloy electrolyte. Such polymeric carrier brighteners are disclosed in U.S. Pat. Nos. 4,401,526; 4,425,198 and 4,488,942, the teachings of which are incorporated herein by reference.

In addition to the foregoing constituents, the electrolyte can optionally further include supplemental additives such as buffering agents and bath modifiers such as boric acid, acetic acid, citric acid, benzoic acid, salicylic acid, as well as their bath soluble and compatible salts. Additionally, conductivity salts can be included to increase the electrical conductivity of the electrolyte and can be employed in amounts usually ranging from about 20 up to about 450 g/l. Typically, such conductivity salts comprise alkali metal and ammonium salts including chlorides and sulfates depending upon the type of electrolyte used. Typical of such conductivity salts are ammonium sulfate, ammonium chloride or bromide, magnesium sulfate, sodium and potassium sulfate, sodium and potassium chloride, and the like. In chloride and mixed chloride-sulfate electrolytes, it is preferred to include at least about 20 g/l of ammonium ions in the electrolyte.

The zinc-nickel alloy electrolyte incorporating the essential ingredients will produce an electrodeposit having a semi-bright appearance. A semi-bright appearance is generally satisfactory for functional or industrial electrodeposits. When a decorative electrodeposit is desired of a fully bright or mirror appearance, supplemental secondary and/or auxiliary brighteners are preferably also included in the electrolyte. Such secondary brightener is added to the bath in an amount sufficient to impart mirror brightness to the deposit up to the maximum solubility of the brightener additive in the bath. Preferably, these secondary brighteners are included in the electroplating bath in amounts from about 0.01 to about 2 grams per liter.

Typical of the aromatic aldehydes or aromatic ketones which may be used as secondary brighteners are the aryl aldehydes and ketones, the ring-halogenated aryl aldehydes and ketones, and heterocyclic aldehydes and ketones. Exemplary of specific compounds which may be used are ortho-chlorobenzaldehyde, para-chlorobenzaldehyde, benzylmethyl ketone, phenylethyl ketone, cinnamaldehyde, benzalacetone, thiophene aldehyde, furfural-5-hydroxymethyl furfural, furfurylidene acetone, furfuraldehyde and 4-(2-furl)-3-buten-2-one and the like.

The electrolytes of the present invention, either with or without the above-described secondary brighteners, may also contain auxiliary low current density area brighteners. Suitable auxiliary brighteners are the lower alkyl carboxylic acids and their bath soluble salts, wherein the alkyl group contains from about 1 to about 6 carbon atoms. Although either the acid itself or the bath soluble salts may be utilized, in many instances the sodium, potassium or ammonium salts are preferred. A particularly preferred auxiliary brightener for use in the present invention is sodium acetate. The auxiliary brighteners are typically utilized in amounts within the range of from about 0.5 to about 20 grams per liter, with amounts within the range of about 1 to about 10 grams per liter being particularly preferred.

In some instances, where the electrolyte is operated at the high end of the pH range, eg, at a pH of from about 7 to about 8, it may also be desirable to include a suitable complexing agent in the bath to prevent precipitation of the zinc and/or nickel metal. Any suitable complexing agent for zinc and/or nickel may be used, in an amount sufficient to prevent the precipitation of zinc and/or nickel from the bath. Typical of the complexing agents which may be used are ethylenediamine tetra-acetic acid, diethylenetetramine penta-acetic acid and Quadrol (N,N,N',N'-tetrakis (2-hydroxypropyl) ethylenediamine).

In accordance with the process aspects of the present invention, the zinc-nickel alloy electrolyte is employed to electrodeposit a zinc-nickel alloy on a conductive substrate employing electolyte temperatures ranging from about room temperature (60° F.) up to about 180° F., and more typically from about 70° to about 140° F. The electrodeposition of the zinc alloy is carried out at average cathode current densities ranging from as low as about 1 up to about 2,000 ASF or higher. For decorative chloride-type and mixed chloride-sulfate type electrolytes, average current densities from about 1 to about 80 ASF are generally preferred, whereas for functional sulfate-type or chloride-type electrolytes, average cathode current densities of from about 20 to about 2,000 ASF can be employed. During the electrodeposition process, tthe bath or electrolyte is preferably agitated mechanically or by solution circulation or part movement. The electrolyte can be employed for both rack as well as barrel plating of work pieces. When zinc and nickel anodes are employed, the relative surface area thereof can be varied to provide the desired replacement of zinc and nickel ions in the electrolyte during its use. Generally, a zinc anode to nickel anode surface area ratio of about 9 to 1 has been found to be effective in maintaining the desired concentration of the zinc and nickel ions in the electrolyte.

In order to further illustrate the electrolyte composition and process of the present invention, the following examples are provided. It will be understood that the examples are provided for illustrative purposes and are not intended to be limiting of the scope of the present invention as herein described and as set forth in the subjoined claims.

EXAMPLE 1

An aqueous acidic sulfate-type electrolyte was prepared containing 60 g/l nickel sulfate hexahydrate, 64 g/l zinc sulfate monohydrate, 32 g/l boric acid as a buffering agent, 30 g/l ammonium sulfate, 0.06 g/l polyacrylamide as an optional carrier brightener preferably employed in sulfate-type electrolytes for electrodepositing a functional zinc-nickel alloy deposit, and 0.3 g/l of benzene sulfonamide as the additive agent.

A steel J-panel was electroplated in the foregoing electrolyte in the presence of air agitation with the electrolyte adjusted to a pH of 4.5 and controlled at a temperature of about 75° F. employing a zinc anode. The electrodeposition was carried out at an average current density of 40 ASF. The resultant plated panel had a fully bright and ductile zinc-nickel deposit in the high current density areas and upon analysis contained 3.2% by weight nickel.

EXAMPLE 2

An aqueous acidic zinc-nickel alloy electrolyte of the sulfate type was prepared containing 255 g/l of nickel sulfate hexahydrate, 175 g/l of zinc sulfate monohydrate, 28 g/l boric acid, 11 g/l ammonium sulfate, 0.025 g/l polyacrylamide and 2.5 g/l of sodium saccharin as the additive agent.

A steel J-panel was electroplated in the foregoing electrolyte employing zinc anodes with the electrolyte controlled at a pH of 4.5 and at a temperature of 75° F. The resultant zinc-nickel alloy deposit was fully bright and ductile over the areas ranging from 25 ASF up to 100 ASF. Upon analysis, the alloy contained 4.23% by weight nickel in the 25 ASF region and 4.83% by weight nickel in the 100 ASF region.

EXAMPLE 3

The same electrolyte as described in Example 2 was prepared with the exception that the pH of the electrolyte was reduced to 3.9. A J-panel was again electroplated under the same conditions as described in Example 2. It was observed that a brighter deposit was obtained in comparison to that obtained with Example 2 and the nickel content in the 100 ASF region increased to 5.8% by weight nickel.

EXAMPLE 4

An electrolyte was again prepared in accordance with Example 2 with the exception that the pH was reduced to about 3. A steel J-panel was again electroplated under the same conditions employed in Examples 2 and 3, and it was observed that a further increase in brightness of the zinc-nickel alloy deposit was obtained in comparison to Example 3. Additionally, the alloy is the 100 ASF region had an increased nickel content of 6.9% by weight.

EXAMPLE 5

An aqueous acidic zinc-nickel alloy electrolyte of the sulfate type was prepared containing 59 g/l zinc-sulfate monohydrate, 271 g/l nickel sulfate hexahydrate and 0.05 g/l butyne diol as the additive agent. The electrolyte was controlled at a pH of about 1 and at a temperature of from about 120°-130° F.

A 0.25 inch diameter steel rod cathode rotating at a speed of 4,600 RPM to provide a surface velocity of about 300' per minute was electroplated at an average current density of 1,000 ASF. Lead anodes were employed in the plating cell. A bright zinc-nickel alloy deposit was obtained which upon analysis contained 18.1% by weight nickel. A duplicate test was conducted under the same conditions with the exception that the electrolyte did not contain any of the additive agent butyne diol. A similar deposit was obtained which upon analysis only contained 15.5% by weight nickel.

EXAMPLE 6

An aqueous acidic electrolyte was prepared according to Example 5 with the exception that the additive agent comprised 0.05 g/l propargyl alcohol.

A rotating steel rod cathode was electroplated under the same conditions as described in Example 5 and a similar zinc-nickel alloy deposit was obtained which upon analysis contained 24.7% by weight nickel. For comparative purposes, a second test was conducted employing the same electrolyte, but without any of the propargyl alcohol additive agent and a similar deposit was obtained, but only contained 17.1% by weight nickel.

EXAMPLE 7

For comparative purposes, a zinc-nickel alloy electrolyte was prepared of the chloride-type containing 100 g/l zinc-chloride, 130 g/l nickel chloride hexahydrate, 200 g/l ammonium chloride, 8 g/l sodium acetate as buffering agent, 5 g/l of a polyoxyalkalene compound comprising 2,4,7,9-tetramethyl-5-decyne-4,7-diol ethoxylated with 30 moles ethylene oxide, 0.05 g/l benzal acetone and the pH was adjusted to 5.3 with ammonium hydroxide.

A steel J-panel was electroplated at an average cathode current density of 25 ASF at an electrolyte temperature of about 93° F. The resultant zinc-nickel alloy deposit was fully bright and contained 9.7% by weight. After standing for a period of one week, microcracks appeared in the deposit evidencing instability of the ductility property of the deposit.

EXAMPLE 8

To the electrolyte as described in Example 7, 0.5 g/l of an additive agent comprising sodium saccharin was added and a J-panel was again plated under the same conditions as described in Example 7. The resultant zinc-nickel alloy deposit was fully bright and contained a similar nickel content of about 9.7% by weight. The alloy deposit was ductile and no microcracking occurred on standing for an indefinite time.

EXAMPLES 9-21

An aqueous acidic zinc-nickel alloy electrolyte was prepared basically containing 100 g/l zinc chloride, 130 g/l nickel chloride hexahydrate, 200 g/l ammonium chloride, 4 g/l ammonium acetate, 5 g/l of a polyoxyalkalene compound comprising 2,4,7,9-tetramethyl-5-decyne-4,9-diol ethoxylated with 30 moles ethylene oxide, 0.1 g/l benzylidene acetone as a secondary brightener. The electrolyte was adjusted to a pH of 5.7 and controlled at a temperature of about 95° F. A Hull-cell was employed for plating steel Hull test panels at a current of 2 amperes for a period of 5 minutes without any agitation.

The foregoing test was repeated with the exception that 0.015 moles per liter of each individual additive agent (1) through (13) as set forth in Table 1 was added and the plating test repeated under the same conditions. Each of the 13 test panels plated employing the individual additive agent produced a non-colored, beautiful specular gloss deposit. In comparison, the test panel plated employing the electrolyte without the additive agent had a dark colored deposit along the low current density area. The effectiveness of the additive agents in the suppression of codeposition of nickel in the low current density areas relative to the electrolyte devoid of any additive agent is summarized in Table 2 in which the additive agents are identified in accordance with the correlation provided in prior Table 1.

TABLE 2

| Example | Additive Agent | Nickel Content (% by wt.) 0.5 /dm²* (4.7 ASF) | 1.0 A/dm² (9.4 ASF) | 5.0 A/dm² (47 ASF) | Cathode Efficiency, % 0.5 A/dm² (4.7 ASF) |
|---|---|---|---|---|---|
| 9 | (1) | 21 | 15 | 7.7 | 76 |
| 10 | (2) | 20 | 15 | 7.6 | 76 |
| 11 | (3) | 19 | 14 | 7.2 | 77 |
| 12 | (4) | 16 | 12 | 6.5 | 81 |
| 13 | (5) | 17 | 14 | 7.4 | 79 |
| 14 | (6) | 18 | 14 | 6.9 | 78 |
| 15 | (7) | 20 | 15 | 7.4 | 75 |
| 16 | (8) | 18 | 14 | 6.9 | 80 |
| 17 | (9) | 16 | 13 | 7.0 | 79 |
| 18 | (10) | 15 | 12 | 6.4 | 82 |
| 19 | (11) | 16 | 13 | 7.0 | 80 |
| 20 | (12) | 17 | 13 | 6.7 | 81 |
| 21 | (13) | 17 | 14 | 7.1 | 79 |
| Control | None | 25 | 17 | 7.7 | 65 |

*amperes per square decimeter

It is apparent from the results as set forth in Table 2 relative to the control, that the use of the additive agents (1)-(13) results in a significant reduction in the codeposition of nickel in the low current density areas, particularly at 4.7 ASF In comparison to the control. It is also apparent that the use of the additive agents produces a significant increase in the cathode efficiency.

EXAMPLE 22

An aqueous acidic zinc-nickel alloy electrolyte was prepared of the chloride type containing 90 g/l zinc chloride, 120 g/l nickel chloride hexahydrate, 200 g/l potassium chloride, 30 g/l boric acid, 6.5 g/l sodium acetate, 4 g/l of a polyoxyalkylene compound comprising 2,4,7,9-tetramethyl-5-decyne-4,7-diol ethoxylated with 30 moles ethylene oxide, 0.05 g/l benzylidene acetone and 1 g/l saccharin. The pH was adjusted to 5.3 A steel J-panel was electroplated employing the foregoing electrolyte and the resultant alloy deposit contained 2% by weight nickel.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. an aqueous acidic electrolyte of the chloride, sulfate or mixed chloride-sulfate type suitable for electrodepositing a zinc-nickel alloy on a substrate comprising an aqueous solution containing zinc ions and nickel ions present in an amount sufficient to electrodeposit a zinc-nickel alloy and an additive agent selected from the group consisting of:

(b) aromatic sulfonamides; sulfonimides and mixed carboxamides/sulfonamides;

(c) acetylene alcohols;

as well as the bath soluble and compatible salts of (b) and mixtures thereof; said additive agents (b) and (c) being present in the electrolyte in an amount effective to impart ductility to the electrodeposit, and/or to provide a substantially uniform alloy composition by suppression of nickel codeposition in the lower current density areas and enhancement of nickel codeposition in the higher current density areas.

2. The electrolyte as defined in claim 1 in which said zinc ions are present in an amount of about 10 g/l up to saturation.

3. The electrolyte as defined in claim 1 in which said zinc ions are present in an amount of about 15 to about 225 g/l.

4. The electrolyte as defined in claim 1 in which said zinc ions are present in an amount of about 20 to about 200 g/l.

5. The electrolyte as defined in claim 1 in which said nickel ions are present in an amount of about 0.5 to about 120 g/l.

6. The electrolyte as defined in claim 1 further including a carrier brightener present in an amount effective to impart grain refinement to the electrodeposit.

7. The electrolyte as defined in claim 1 of the chloride, sulfate and mixed chloride-sulfate type in which said additive agent (b) and (c) are present in an amount of at least about 0.0001 mole per liter.

8. The electrolyte as defined in claim 7 in which said additive agent (b) and (c) are present in an amount of about 0.001 to about 0.01 mole per liter.

9. The electrolyte as defined in claim 1 of the chloride and mixed chloride-sulfate type in which the additive agent, (b) and (c) are present in an amount of about 0.001 to about 0.1 mole per liter.

10. The electrolyte as defined in claim 9 in which said additive agent (b) and (c) are present in an amount of at least about 0.01 mole per liter.

11. The electrolyte as defined in claim 6 in which said carrier brightener comprises a polyoxyalkylene compound present in an amount of about 0.005 g/l up to saturation.

12. The electrolyte as defined in claim 6 in which said carrier brightener comprises a polyoxyalkylene compound present in an amount of about 0.1 to about 200 g/l.

13. The electrolyte as defined in claim 6 in which said carrier brightener comprises a polyacrylamide compound as well as the N-substituted derivatives thereof present in an amount of about 0.001 up to the solubility limit in the electrolyte

14. The electrolyte as defined in claim 6 in which said carrier brightener comprise a polyacrylamide compound as well as the N-substituted derivatives thereof present in an amount of about 0.1 to about 5 g/l.

15. The electrolyte as defined in claim 1 further including hydrogen ions to provide a pH of from about 0 up to about neutral.

16. The electrolyte as defined in claim 1 further including hydrogen ions to provide a pH of from about 2 to about 6.

17. The electrolyte as defined in claim 1 further including a buffering agent.

18. The electrolyte as defined in claim 1 further including a secondary brightening agent present in an amount effective to impart.

19. The electrolyte as defined in claim 1 further including a secondary brightening agent present in an amount of about 0.01 to about 2 g/l.

20. The electrolyte as defined in claim 1 further including an auxiliary brightening agent.

21. The electrolyte as defined in claim 20 in which said auxiliary brightening agent is present in an amount of about 0.5 to about 20 g/l.

22. The electrolyte as defined in claim 20 in which said auxiliary brightening agent is present in an amount of about 1 to about 10 g/l.

23. The electrolyte as defined in claim 1 further including electrolyte soluble and compatible conductivity salts present in an amount up to about 450 g/l.

24. The electrolyte as defined in claim 1 of the chloride and mixed chloride-sulfate type further including at least about 20 g/l ammonium ions.

25. The electrolyte as defined in claim 1 further including a complexing agent for the zinc ions and nickel ions.

26. The electrolyte as defined in claim 1 in which the additive agent (b) comprises a compound corresponding to the General Formula II;

GENERAL FORMULA II

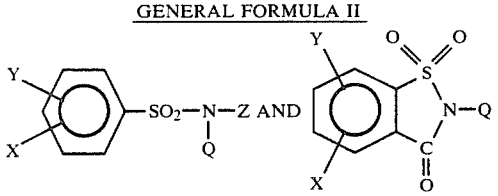

Wherein:

X is H, $C_1$–$C_6$ alkyl, $C_6$–$C_{10}$ aryl which can be adjacent to the phenyl ring, $C_7$–$C_{22}$ alkyl aryl, OH, halogen, CHO, $C_1$–$C_4$ alkoxy, $C_1$–$C_6$ carboxy, $C_1$–$C_6$ hydroxyl alkyl, or $C_1$–$C_6$ sulfoalkyl;

Y is H, $C_1$–$C_6$ alkyl, OH, $SO_3M$, or phenyl;

Q is H, M, $C_1$–$C_3$ alkyl, $C_1$–$C_6$ sulfo alkyl, $C_1$–$C_6$ hydroxy alkyl, $C_1$–$C_4$ alkoxy sulfo;

M is H, $NH_4$, Zinc, Nickel or Group IA and IIA metals;

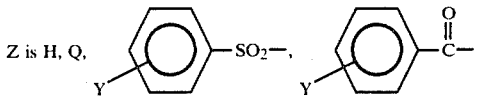

as well as the bath soluble and compatible salts and mixtures thereof.

27. The electrolyte as defined in claim 1 in which the additive (c) comprises a compound corresponding to the General Formula III;

GENERAL FORMULA III

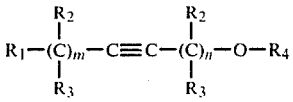

wherein:

m is an integer from 0 to 4;

n is an integer from 1 to 4

$R_1$ is H, a $C_1$–$C_6$ alkyl when m is O;

$R_1$ is —O—$R_4$ when m is greater than O;

$R_2$ & $R_3$ is H, $C_1$–$C_4$ alkyl or sulfo alkyl;

$R_4$ is H or

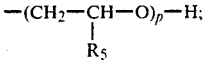

p is an integer from 1 to 4;

$R_5$ is H or a $C_1$–$C_2$ alkyl;

as well as the bath soluble and compatible salts and mixtures thereof.

28. The electrolyte as defined in claim 1 in which the additive agent (c) comprises a compound selected from the group consisting of:

3-methyl-1-butyne-3 ol $HC{\equiv}CC(CH_3)_2O(CH_2CH_2O)_2H$ comprising the ethylene oxide adduct of 3-methyl-1-butyne-3 ol;

Butynediol;

$HOCH_2CH_2OCH_2{\equiv}OCH_2OCH_2CH_2OH$ comprising the ethylene oxide adduct of butynediol;

$HOCH_2C{\equiv}CCH_2OCH_2CH_2OH$;

Propargyl alcohol;

$HC{\equiv}CCH_2OCH_2CH_2OH$ comprising the ethylene oxide adduct of propargyl alcohol;

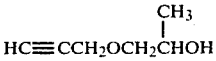

comprising the propylene oxide adduct of propargyl alcohol;

Hexynediol; as well as mixtures thereof.

29. A process for electrodepositing a zinc-nickel alloy on a conductive substrate which comprises the steps of contacting a cathodically electrified substrate with an aqueous electrolyte comprising an aqueous solution containing zinc ions and nickel ions present in an amount sufficient to electrodeposit a zinc-nickel alloy and an additive agent selected from the group consisting of:

(b) aromatic sulfonamides; sulfonimides and mixed carboxamides/sulfonamides;

(c) acetylene alcohols;

as well as the bath soluble and compatible salts of (b) and mixtures thereof; said additive agents (b) and (c) being present in the electrolyte in an amount effective to impart ductility to the electrodeposit, and/or chloride-sulfate electrolyte in an amount effective to provide a substantially uniform alloy composition by suppression of nickel codeposition in the lower current density areas, and enhancement of nickel codeposition in the higher current density areas, and continuing the electrodeposition of the zinc-nickel alloy until the desired thickness is obtained.

30. The process as defined in claim 29 including the further step of controlling the temperature of the electrolyte within a range of about 60° F. to about 180° F.

31. The process as defined in claim 29 including the further step of controlling the pH of the electrolyte within a range of about 0 up to about neutral.

32. The process as defined in claim 29 in which the step of electrodepositing the zinc-nickel alloy is performed at an average cathode current density of from about 1 up to about 2,000 ASF.

33. The process as defined in claim 29 in which said electrolyte further contains a carrier brightener.

* * * * *